US007057348B2

(12) United States Patent
Miyazawa

(10) Patent No.: US 7,057,348 B2
(45) Date of Patent: Jun. 6, 2006

(54) DISCHARGE TUBE FOR HIGH-PRESSURE DISCHARGE LAMP AND HIGH-PRESSURE DISCHARGE LAMP

(75) Inventor: Sugio Miyazawa, Kasuagi (JP)

(73) Assignee: NGK Insulators, Ltd., Nagoya (JP)

( * ) Notice: Subject to any disclaimer, the term of this patent is extended or adjusted under 35 U.S.C. 154(b) by 155 days.

(21) Appl. No.: 10/488,526

(22) PCT Filed: Oct. 11, 2002

(86) PCT No.: PCT/JP02/10567

§ 371 (c)(1),
(2), (4) Date: Mar. 3, 2004

(87) PCT Pub. No.: WO03/034465

PCT Pub. Date: Apr. 24, 2003

(65) Prior Publication Data

US 2004/0201353 A1 Oct. 14, 2004

(30) Foreign Application Priority Data

Oct. 11, 2001 (JP) ..... 2001-313839

(51) Int. Cl.

| | |
|---|---|
| ***H01J 5/02*** | (2006.01) |
| ***H01J 17/16*** | (2006.01) |
| ***H01J 61/30*** | (2006.01) |
| ***H01J 61/33*** | (2006.01) |

(52) U.S. Cl. ..... 313/634; 313/493; 313/573

(58) Field of Classification Search ..... 313/634, 313/573, 493

See application file for complete search history.

(56) References Cited

U.S. PATENT DOCUMENTS

| | | | | |
|---|---|---|---|---|
| 4,503,356 | A * | 3/1985 | Kobayashi et al. | 313/634 |
| 5,363,007 | A | 11/1994 | Fromm et al. | |
| 5,552,670 | A | 9/1996 | Heider et al. | |
| 6,781,311 | B1 | 8/2004 | Miyazawa | |
| 2005/0168148 | A1 * | 8/2005 | Allen et al. | 313/634 |

FOREIGN PATENT DOCUMENTS

| | | | |
|---|---|---|---|
| HU | 214135 | B | 4/1993 |
| HU | P0104626 | A | 6/2002 |
| JP | 60148033 | A * | 8/1985 |
| JP | A 6-318435 | | 11/1994 |
| JP | A 7-176296 | | 7/1995 |
| JP | A 8-148118 | | 6/1996 |
| JP | A 9-147803 | | 6/1997 |
| JP | A 10-134768 | | 5/1998 |
| JP | A 10-188893 | | 7/1998 |
| JP | A 11-73917 | | 3/1999 |
| JP | A 11-96972 | | 4/1999 |
| JP | A 2000-285857 | | 10/2000 |
| JP | A 2002-245971 | | 8/2002 |

* cited by examiner

*Primary Examiner*—Mariceli Santiago
(74) *Attorney, Agent, or Firm*—Oliff & Berridge, PLC

(57) ABSTRACT

It is provided a ceramic vessel for a high pressure discharge lamp and for filling an ionizable luminous substance and a starter gas in the inner space of the vessel. The discharge vessel has a tubular central luminous portion, and a pair of tubular end portions protruding from both ends of said central luminous portion, respectively. Each of the end portions has a maximum wall thickness "l" of 0.5 times or larger and 0.9 times or smaller of the wall thickness "t" of the central luminous portion. A ceramic discharge vessel is thereby provided enabling for improving the luminous efficiency of the high pressure discharge lamp.

11 Claims, 10 Drawing Sheets

DISCHARGE TUBE FOR HIGH-PRESSURE DISCHARGE LAMP AND HIGH-PRESSURE DISCHARGE LAMP

FIELD OF THE INVENTION

The present invention relates to a high pressure discharge lamp and discharge vessels therefor.

BACKGROUND OF THE INVENTION

A high pressure discharge lamp has a ceramic discharge vessel with two end portions. Sealing members (usually referred to as a ceramic plug) are inserted, respectively, to seal the respective end portions. A through hole is formed in each sealing member. A metal member with a specific electrode system is inserted in the through hole. An ionizable light-emitting material is introduced and sealed in the inner space of the discharge vessel. Known high pressure discharge lamps include high pressure sodium vapor and metal halide lamps, the latter exhibiting more superior color coordination. The lamp can be used under high temperature condition by forming the discharge vessel with a ceramic material.

In such discharge lamp, it is necessary to air-tightly seal between the end portion of the ceramic discharge vessel and a member for supporting an electrode system. The ceramic discharge vessel has a main body with a shape of a tube with two narrow ends, or a barrel, or a straight tube. The discharge vessel is made of, for example, an alumina sintered body. The respective ends of the discharge vessel may be sealed as described, for example, in Japanese patent publication 6-318, 435A. Further, Japanese patent publication 7-176, 296A discloses a method for sealing a metal vapor luminous vessel.

DISCLOSURE OF THE INVENTION

For improving the luminance of a high pressure discharge lamp, it is necessary to improve the transparency of the vessel so as to prevent absorption of light by ceramics emitted from a luminous substance in the vessel and to improve the emission of the light from the outer surface of the vessel. The vessel has been commonly formed of transparent alumina having a high transparency on this viewpoint. It is also known to reduce the wall thickness of the discharge vessel made of transparent alumina to further improve the transparency of the discharge vessel.

The present inventor has studied such prior high pressure discharge lamps and encountered the difficulty of improving the luminance efficiency. It is further found that a luminous substance may be liquefied, in particular, around the end portions of the discharge vessel so that the luminance efficiency of the vessel can be further reduced.

An object of the present invention is to provide a ceramic discharge vessel for improving the luminous efficiency of a high pressure discharge lamp.

The present invention provides a ceramic discharge vessel for a high pressure dirge lamp and for filling an ionizable luminous substance and a starter gas in the inner space of the vessel. The vessel has a tubular central luminous portion, and a pair of tubular end portions protruding from both ends of the luminous portion, respectively. Each of the end portions has a maximum wall thickness smaller than that of the central luminous portion.

The present invention further provides a high pressure discharge lamp, having the above discharge vessel, an electrode system provided in the inner space of the discharge vessel, a sealing member fixed on the end portion of the vessel and a conductive member fixed on the sealing member and equipped with the electrode system The present inventor has found that a luminous substance tends to be liquefied and stored in the inner space of a discharge vessel, particularly in and, around the inner space of the end of the discharge vessel. The investors have further investigated the mechanism and reached the following discovery. That is, the temperature in and around the end portion of the discharge vessel tends to be reduced during light emission. It is thus considered that the luminous substance circulating in the discharge vessel is temporary liquefied and stored in and around the end portion. Such liquefied and stored luminous substance reduces the amount of vapor of the luminous substance available for light emission to lower the intensity of light emission.

The inventor has further investigated the mechanism and found that the design of the discharge vessel may contribute to the liquefaction of the luminous substance. That is, in a prior discharge vessel for a high pressure discharge lamp, as in a discharge vessel 11 shown in FIG. 2, a central luminous portion 12 has a wall thickness "t" same as or smaller than the wall thickness "l" of the end portion 13. That is, the wall thickness "t" of the central luminous portion 12 is designed to be smaller, so as to improve the transparency of the central luminous portion 12.

The discharge arc tends to expand toward the outer periphery of the discharge vessel basically in the central luminous portion and to contract in the end portions 13. The amount of energy supplied from the discharge arc to the discharge vessel is the largest to elevate the temperature of the vessel and to record the maximum temperature, particularly in the center of the central luminous portion 12. The maximum temperature should be not higher than an upper limit required for a ceramic material for the discharge vessel. The upper limit is predetermined depending on the endurance temperature limit of a ceramics constituting the discharge vessel and design margin. During the discharge process, the temperature of the discharge vessel is reduced from the center of the central luminous portion 12 toward the end portions 18 of the discharge vessel.

The luminous substance may be liquefied and stored in an inner space 6 of the end portion 13 and a part of an inner space 5 near the end portion 13, depending on the state of light emission. This is because the temperature in and around the inner space 5 of the end portion 13 is sufficiently reduced compared with a lower limit required for the stable vaporization of the luminous substance.

On the other hand, it is necessary to increase a power supply to the whole discharge vessel for maintaining the temperature in the end portion 13 at a high temperature well over the lower limit for avoiding the liquefaction of the luminous substance. In this case, the maximum temperature in the central luminous portion 12 is elevated and thus may exceed the upper limit of the discharge vessel described above. Further, even when the power supply is increased to excessively elevate the temperature of the central luminous portion, the contribution of an increase of the power supply to the luminous efficiency of the whole discharge vessel is not considerable, compared with the increase of the power supply.

As shown in FIG. 1, the inventor has tried to make the wall thickness "t" of a central luminous portion 2A larger, and thus thicker, than the wall thickness "l" of the end portion 3. It is thus possible to reduce the temperature rise of the central luminous portion 2A, particularly the center, and to facilitate the temperature rise in the end portion 3. The difference of the maximum temperature in the central luminous portion 2A and the temperature of the end portion 3 can be thus reduced. Even when the temperature in the central luminous portion 2A is made sufficiently lower than the upper limit, the temperature drop in the end portion 3 and a region near the end portion is relatively small to prevent the liquefaction of the luminous substance therein. It is thus proved that the overall luminous efficiency of the discharge vessel can be improved.

In a prior high pressure discharge lamp, the wall thickness "t" of the central luminous portion 12 has been reduced as possible for preventing the absorption of light in the central luminous portion 12, as described above. It is considered that the above investigation performed by the inventor has not been performed due to the technical background as described above.

The effects, features and advantages of the invention will be appreciated upon reading the following description of the invention when taken in conjunction with the attached drawings, with the understanding that some modifications, variations and changes of the same could be made by the skilled person in the art.

BEST MODES FOR CARRYING OUT THE INVENTION

According to the present invention, a discharge vessel has an end portion having a maximum wall thickness smaller than the maximum wall thickness of a central luminous portion. The maximum wall thickness of the end portion may preferably be 0.9 times or smaller, and more preferably 0.8 times or smaller, of the maximum wall thickness of the central luminous portion, on the viewpoint of the present invention. The maximum wall thickness of the end portion may preferably be 0.5 times or larger of the maximum wall thickness of the central luminous portion. When the maximum wall thickness of the end portion is lower than 0.5 times of that of the central luminous portion, fracture may occur in the end portion. The maximum wall thickness of the end portion of the discharge vessel may preferably be 0.6 times or larger of that of the central luminous portion for improving the strength of the end portion.

Figure 1:
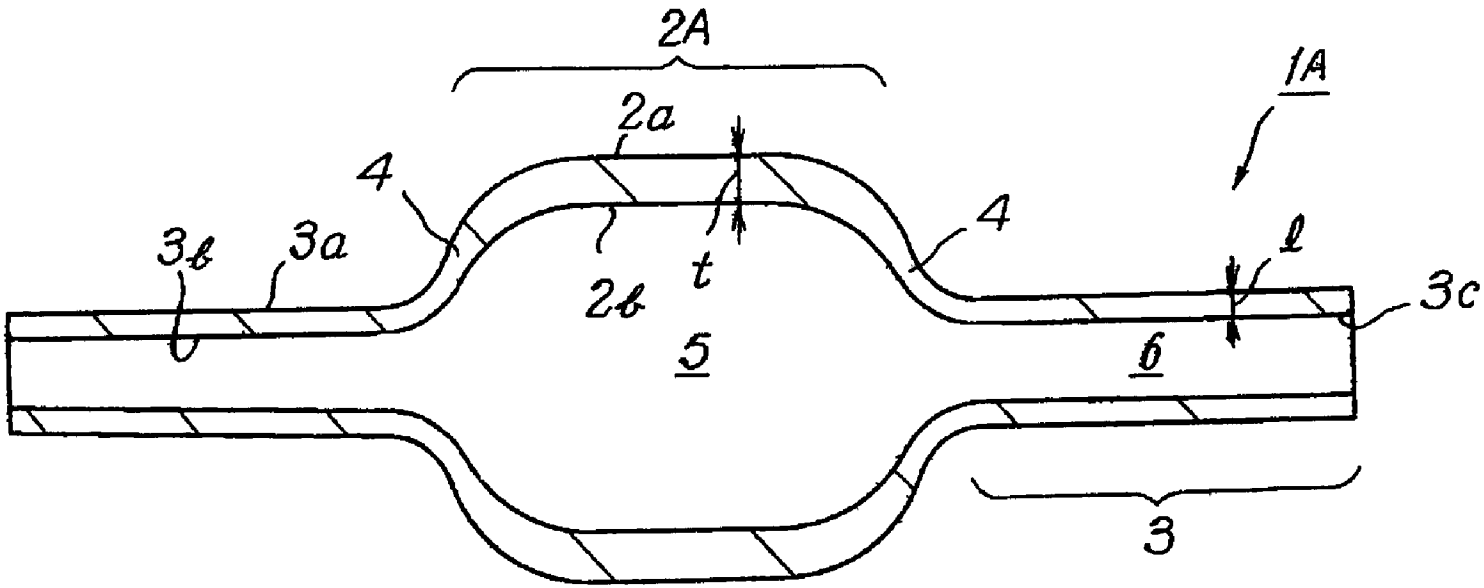
FIG. 1 is a longitudinal sectional view schematically showing a discharge vessel 1A according to one embodiment of the present invention.

The present invention will be described further in detail referring to the attached drawings. FIG. 1 is a longitudinal sectional view schematically showing a discharge vessel 1A according to one embodiment of the present invention. The discharge vessel 1A has a cylindrical central luminous portion 2A, a pair of tube-shaped end portions 3 provided at both ends of the central luminous portion 2A, and a pair of connecting portions 4 each connecting the central luminous portion 2A and end portion 3. An inner space 5 inside of the central luminous portion 2A and an inner space 6 inside of the end portion 6 are communicated with each other. 2*a* represents an outer surface and 2*b* represents an inner surface of the central luminous portion 2A 3*a* represents an outer surface of the end portion 3, and 3*b* represents an inner surface of the end portion 3.

According to the present example, the wall thickness "t" of the central luminous portion 2A is substantially constant over the whole of the central luminous portion 2A. According to the present invention, the wall thickness "1" of the end portion 3 is made 0.9 times or smaller and 0.5 times or larger of the wall thickness "t" of the central luminous portion 2A.

Figure 3:
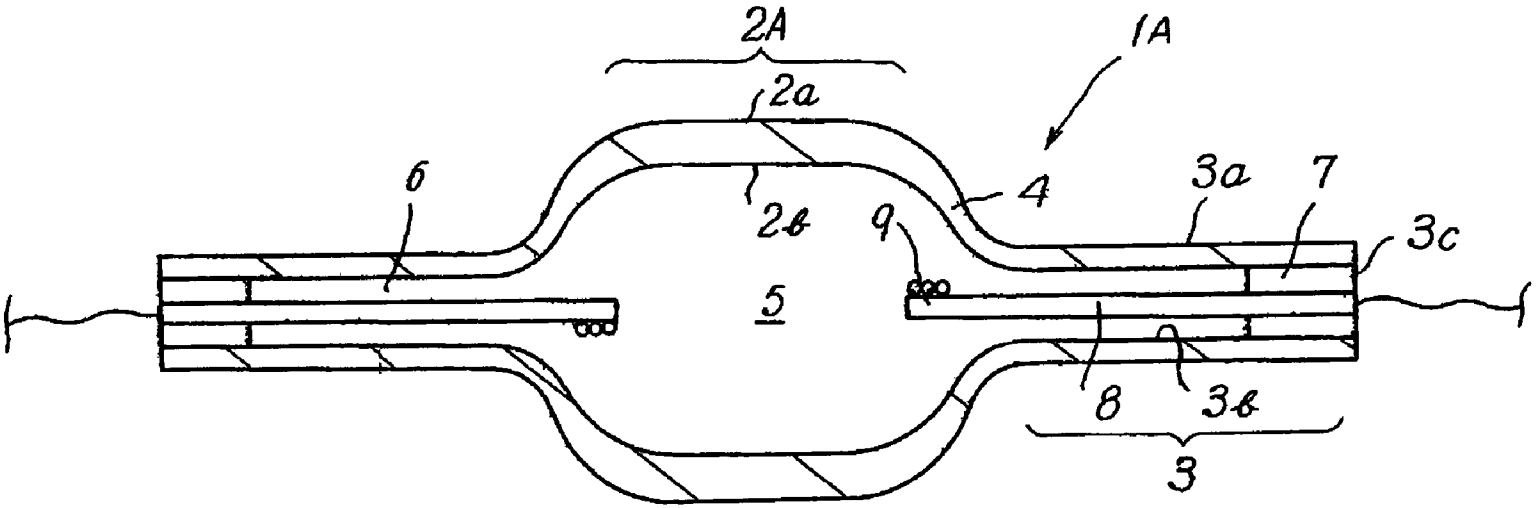
FIG. 3 is a longitudinal sectional view schematically showing a high pressure discharge lamp utilizing the discharge vessel 1A shown in FIG. 1.

FIG. 3 is a longitudinal cross sectional view schematically showing an example of a design of a high pressure discharge lamp utilizing the discharge vessel shown in FIG. 1. A conductive member 8 is fixed on the end portion 3 of the discharge vessel 1A at a position near an opening 3*c* with a sealing glass 7. Electrode members 9 are provided on the end portions of the conductive members, respectively. An ionizable luminous substance and a starter gas are filled in the inner spaces 5 and 6 so as to generate arc dirge between a pair of the electrode members 9.

The end portion has the maximum width at the cross section (typically outer diameter) smaller than the maximum width at the cross section (typically outer diameter) of the central luminous portion. The end and central luminous portions are tube shaped, are not particularly limited and may be specifically cylindrical or barrel shaped. Further, the shape of the central luminous portion may be spherical. Such spherical shape includes an ideal sphere, a sphere like shape, an ellipsoid of revolution and the other body of revolution.

In a preferred embodiment, the end portion has a minimum wall thickness of 0.5 mm or larger. It is thus possible to sufficiently improve the mechanical strength of the end portion.

The material of the discharge vessel is not particularly limited, and includes translucent materials preferably selected from the group consisting of alumina, yttria, yttrium aluminum garnet and quartz. A translucent alumina is most preferred.

The material of the conductive member may preferably be one or more metal selected from the group consisting of molybdenum, tungsten, rhenium, niobium and tantalum. Alternatively, the material of the conductive member may preferably be a conductive cermet of the one or more metal described above and a ceramics selected from the group consisting of alumina, yttria and quartz. Such conductive cermet is advantageous, because the difference of the thermal expansion coefficients of the conductive cermet and the sealed ceramic discharge vessel can be reduced to prevent the thermal stress.

A glass for sealing may preferably be a mixture of two or more ceramics selected from the group consisting of alumina yttria, quartz and a rare earth oxide.

In the case of a metal halide high pressure discharge lamp, an inert gas such as argon and a metal halide, with optionally mercury, are sealed in the inner space of the ceramic discharge vessel.

In a preferred embodiment, the discharge vessel has a protrusion with a substantially constant wall thickness on the outer surface of the central luminous portion. The wall thickness of the central luminous portion has the maximum at the protrusion. In this case, a protrusion may not be provided on the inner surface of the, central luminous portion so that the inner surface is made substantially flat. It is possible to prevent the corrosion of the inner surface due to discharge arc compared with the vessel having a protrusion on the inner surface of the central luminous portion, by applying the above described shape.

Figure 4:
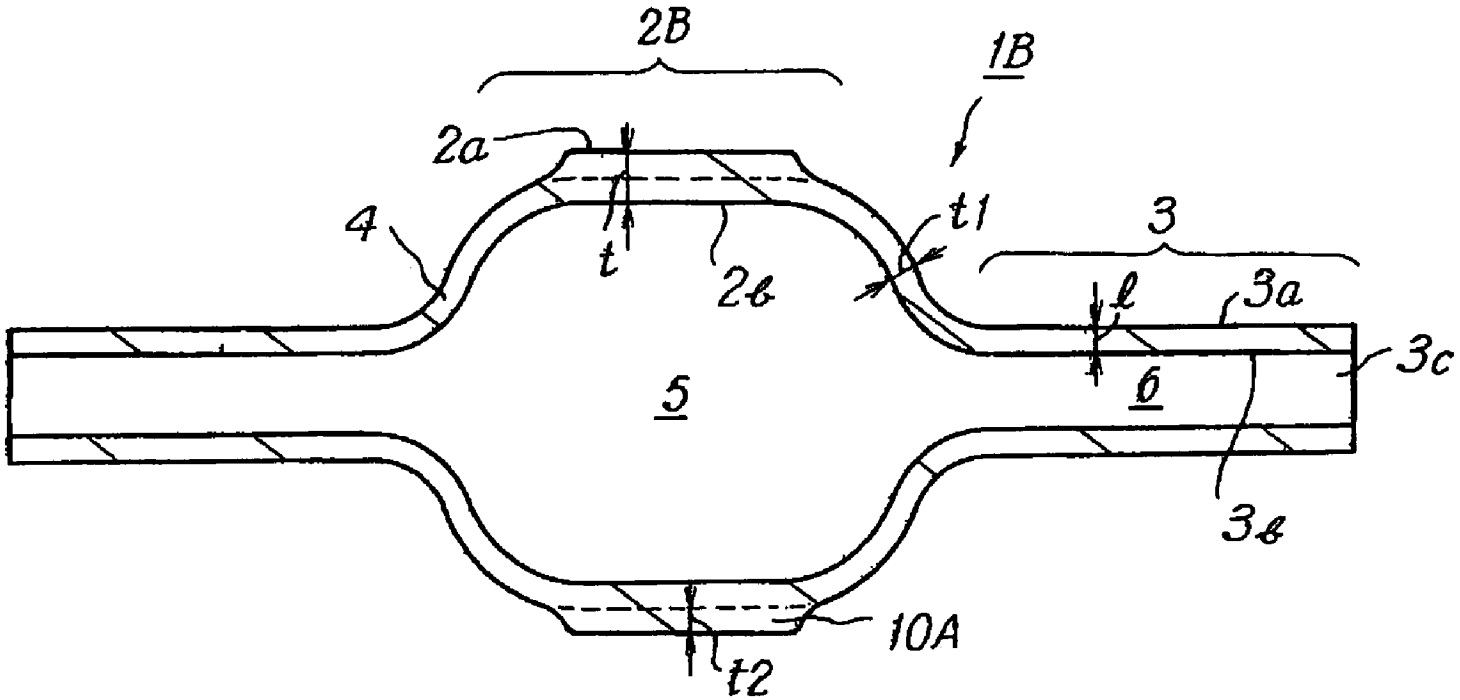
FIG. 4 is a longitudinal sectional view schematically showing a discharge vessel 1B according to another embodiment, the discharge vessel 1B having a protrusion 10A on the outer surface of the discharge vessel 1B.

FIG. 4 shows a discharge vessel 1B according to this embodiment. The discharge vessel 1B has a cylindrical central luminous portion 2B. A protrusion 10A having a substantially constant thickness is provided on the outer surface 2*a* and surround the outer surface of the central luminous portion 2B. The wall thickness of the central luminous portion 2B takes the maximum wall thickness "t" at the protrusion 10A. A protrusion is not provided on the substantially flat inner surface 2*b* of the central luminous portion 2B. The maximum wall thickness "t" is a sum of a wall thickness "t1" till of a connecting portion 4 of the central luminous portion 2B adjacent to the end portion 3, and a thickness "t2" of a protrusion 10A. The discharge arc contacts the inner surface 2*b* of the central luminous portion 2B to elevate the temperature of the luminous portion, so that the corrosion tends to be progressed. It is thus possible to reduce the corrosion of the inner surface by providing the protrusion 10A on the outer surface 2*a* of the central luminous portion and to make the inner surface 2*b* substantially flat.

In a preferred embodiment, the discharge vessel has a protrusion with a substantially constant thickness on the inner surface of the central luminous portion. The wall thickness of the central luminous portion has the maximum at the protrusion. In this case, a protrusion may not be provided on the outer surface of the central luminous portion so that the outer surface is made substantially flat. It is possible to reduce the outer dimension of the discharge vessel by applying the shape described above. Further, when the temperature of the discharge vessel is excessively high due to overcurrent or the like, cracks tends to be induced starting from the outer surface. It is possible to prevent the concentration of stress on the outer surface to reduce the fracture such as bursting by providing the substantially flat outer surface without a protrusion thereon.

Figure 5:
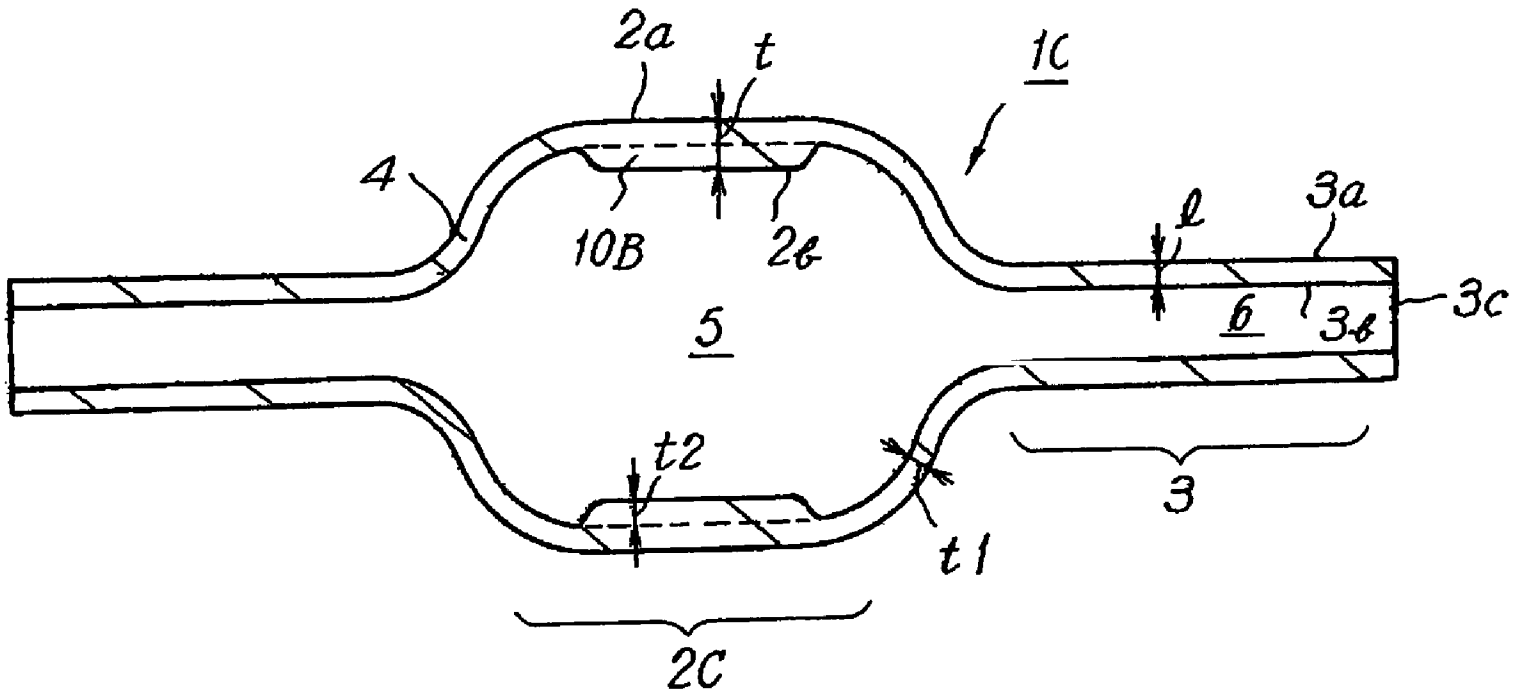
FIG. 5 is a longitudinal sectional view schematically showing a discharge vessel 1C according to still another embodiment, the discharge vessel 1C having a protrusion 10B on the inner surface of the discharge vessel 1C.

FIG. 5 shows a discharge vessel 1C according to this embodiment. The discharge vessel 1C has a central luminous portion 2C. A protrusion 10B having a substantially constant thickness is provided on the inner surface 2*b* and surround the inner space of the central luminous portion 2C. The wall thickness of the central luminous portion 2C has the maximum wall thickness "t" at the protrusion 10B. A protrusion is not provided on the substantially flat outer surface 2*a* of the central luminous portion 2C. The maximum wall thickness "t" is a sum of a wall thickness "t1" of a connecting portion 4 of the central luminous portion 2C adjacent to the end portion 3, and a thickness "t1" of a protrusion 10B.

In a preferred embodiment, the distribution of the wall thickness is provided in the central luminous portion. That is, the minimum wall thickness is made 0.5 times or larger and 0.9 times or smaller of the maximum wall thickness of the central luminous portion. The advantageous effects will be described below.

The discharge vessel is not necessarily fixed along the vertical and may fixed horizontally or in an inclined state. For example, when the discharge vessel is fixed along a horizontal axis, the temperature inside of the discharge vessel may be deviated to result in the deformation of discharge arc. Specifically, the discharge arc tends to bent toward the upper half of the discharge vessel in the inner space of the vessel. As a result, the temperature of the upper part of the central luminous portion is elevated compared with that of the lower part, so that the temperature difference is made larger in the inner space of the central luminous portion. As a result, the luminous substance tends to be liquefied and stored in the lower part, especially near the end portion 3, of the central luminous portion, as described above.

Contrary to this, the minimum wall thickness is made 0.9 times or smaller of the maximum wall thickness of the central luminous portion, so that the thinner part may be fixed downwardly and the thicker part may be fixed upwardly when the discharge vessel is fixed. The thermal capacity of the upper part of the central luminous portion is thus made larger to reduce the temperature rise in the upper part and temperature difference between the upper and lower parts. It is thus possible to improve the luminous efficiency in the central luminous portion. On the viewpoint, the minimum wall thickness of the central luminous portion may preferably be 0.8 times or smaller of the maximum wall thickness thereof.

Further, the minimum wall thickness of the central luminous portion may preferably be 0.5 times or larger, and more preferably be 0.6 times or larger, of the maximum wall thickness thereof for maintaining the strength of the, luminous portion at a sufficiently high value. Further, the minimum wall thickness of the central luminous portion may preferably be 0.5 mm or larger on the viewpoint.

Figure 6:
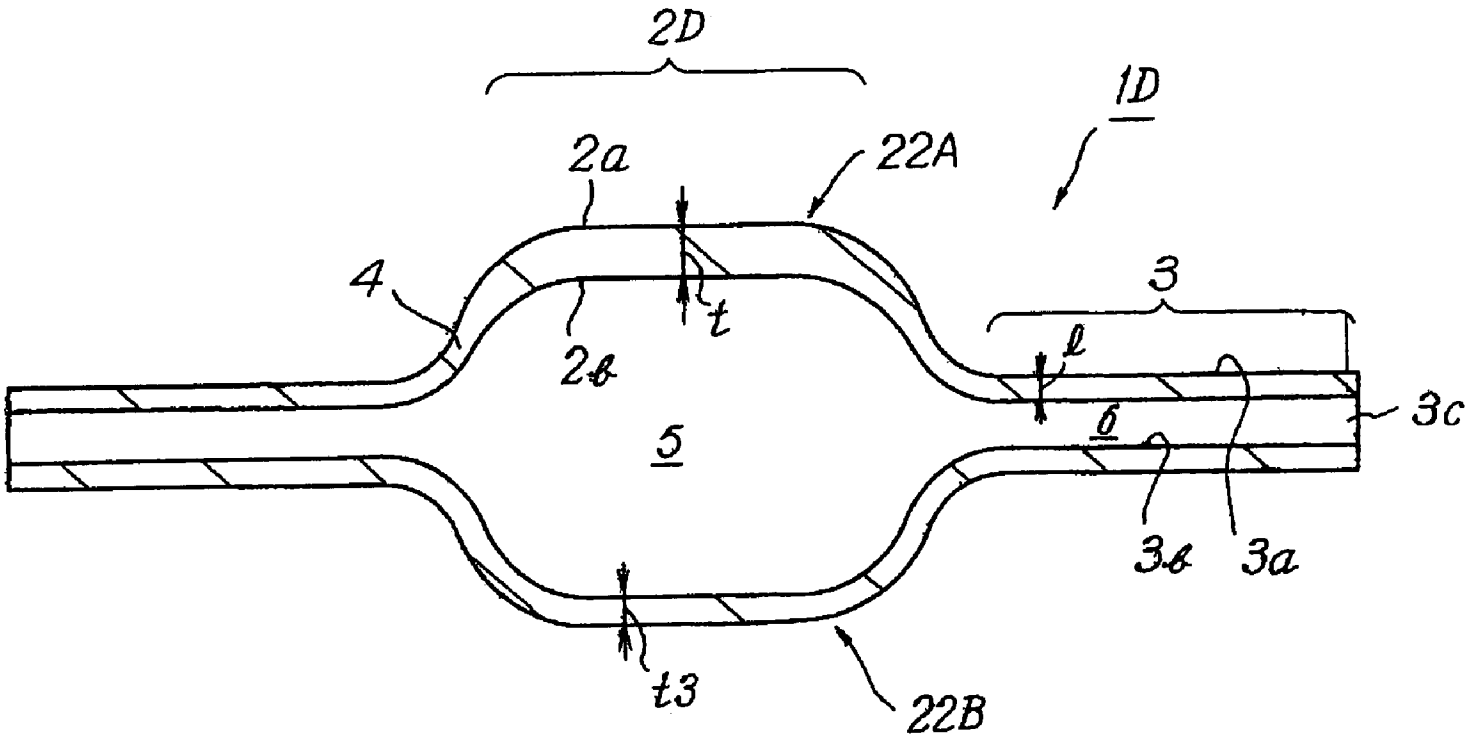
FIG. 6 is a longitudinal sectional view schematically showing a discharge vessel 1D having a central luminous portion 2D with an upper part 22A and a lower part 22B according to still another embodiment, the upper part 22A having a wall thickness "t" larger than the wall thickness "t3" of the lower part 22B.
Figure 7:
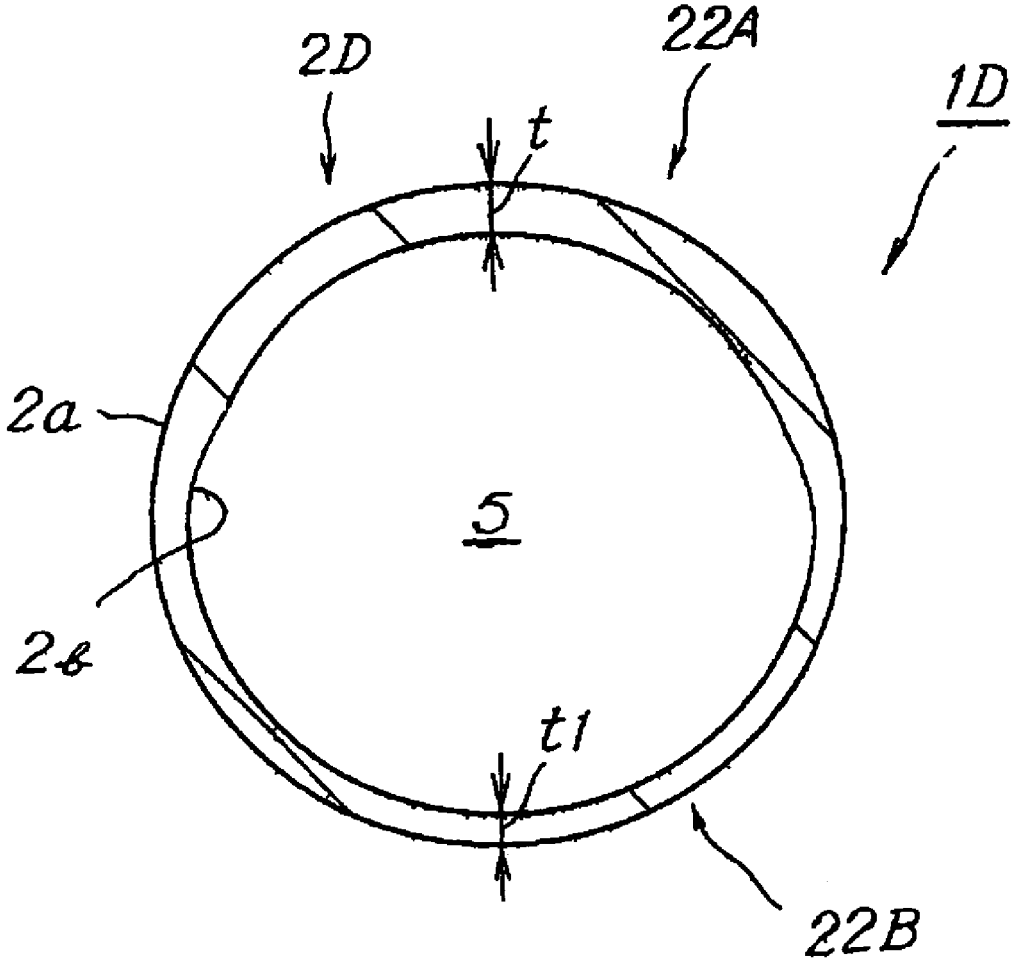
FIG. 7 is a cross sectional view showing the discharge vessel 1D shown in FIG. 6.

FIG. 6 shows a longitudinal sectional view showing a discharge vessel 1D according to the present embodiment. FIG. 7 is a cross sectional view showing a central luminous portion 2D of the discharge vessel 1D. The discharge vessel 1D has a central luminous portion 2D and a pair of end portions 3. The central luminous portion 2D has an upper part 22A and a lower part 22B. As shown in FIG. 7, the upper part 22A has a wall thickness "t" larger than the wall thickness "t1" of the lower part 22B. It is thus possible to reduce the temperature difference between the upper part 22A and lower part 22B, when the discharge arc is deformed and expanded toward the upper part 22A in the inner space 5.

Figure 8:
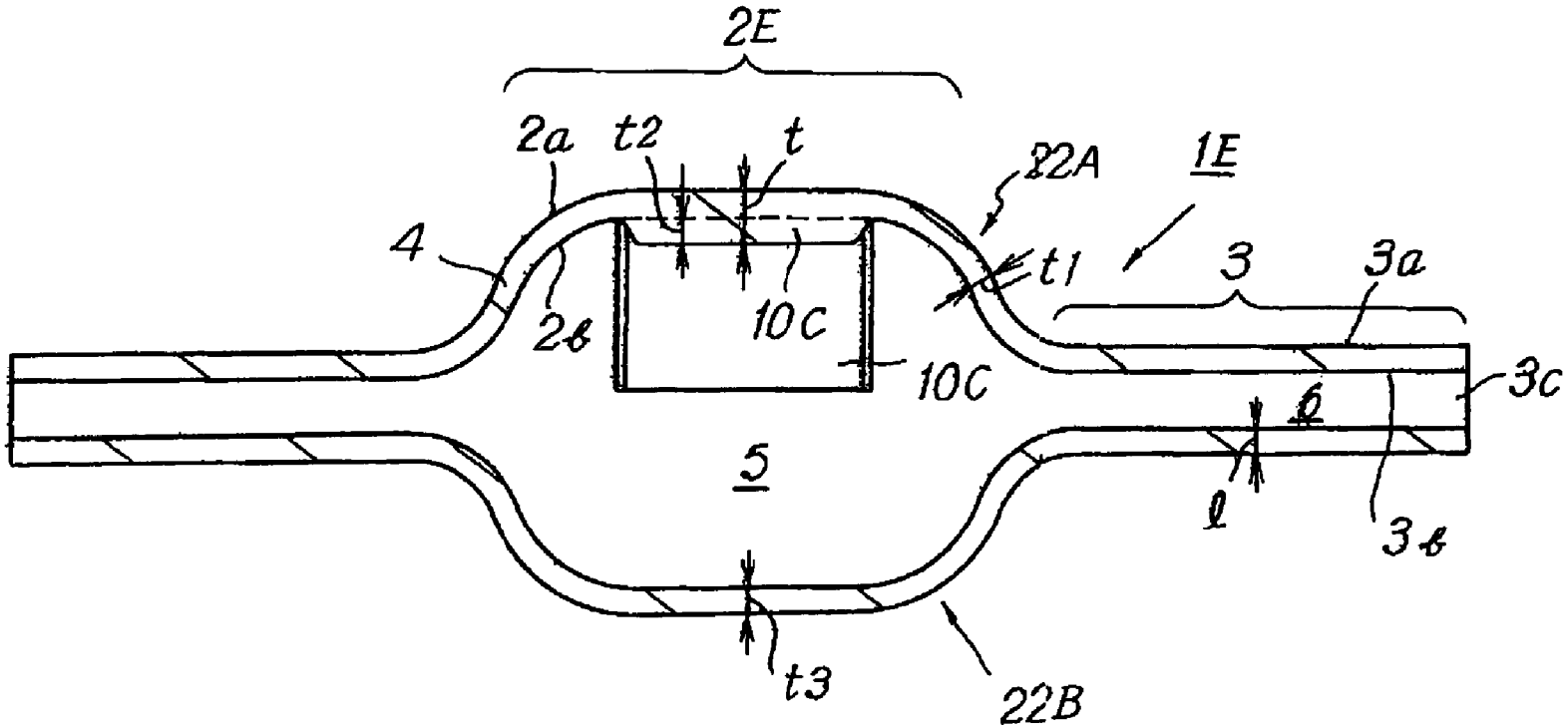
FIG. 8 is a longitudinal sectional view schematically showing a discharge vessel 1E having a central luminous portion 2E with an upper part 22A and a lower part 22B according to still another embodiment, the upper part 22A having a wall thickness "t" larger than the wall thickness "t3" of the lower part 22B.
Figure 9:
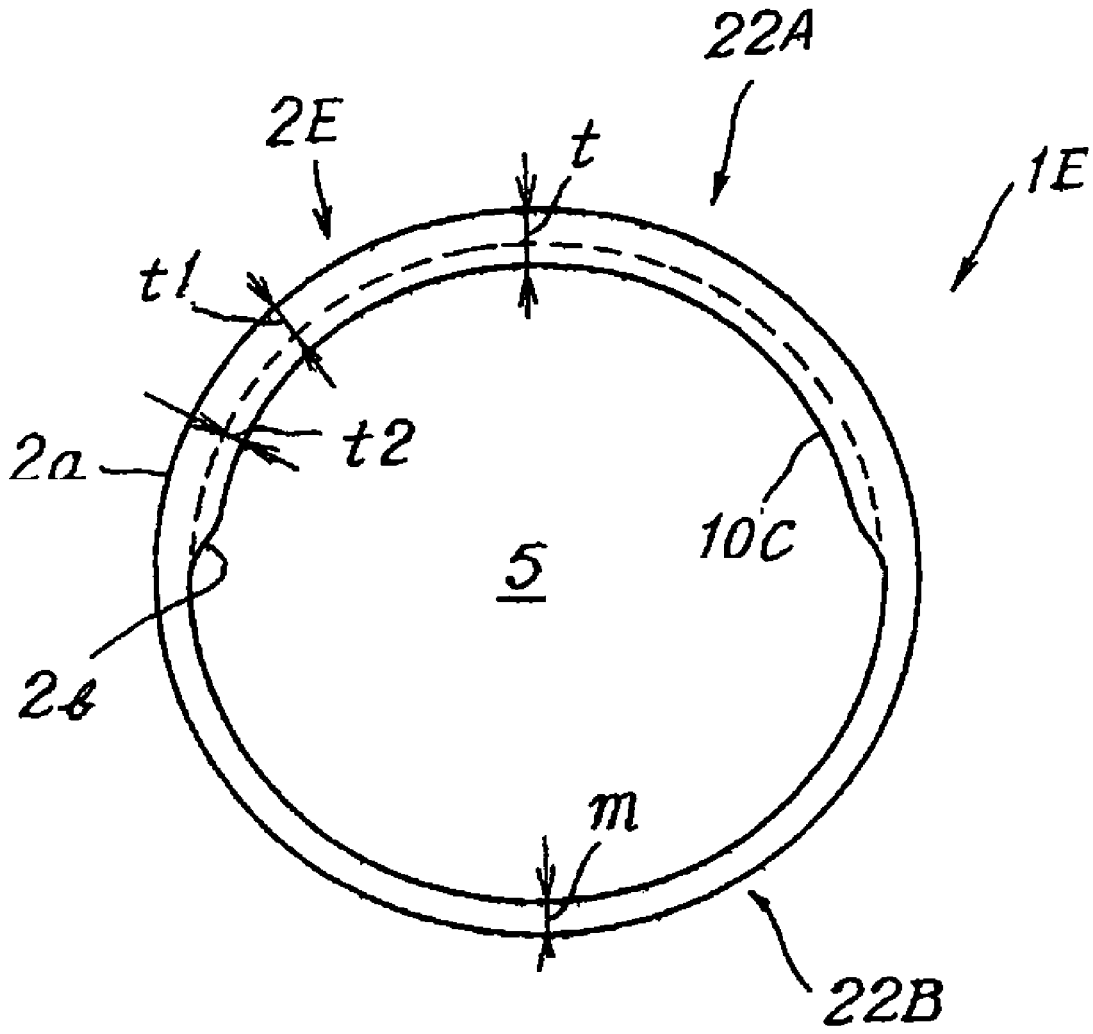
FIG. 9 is a cross sectional view showing the discharge vessel 1E shown in FIG. 8.

FIG. 8 is a longitudinal sectional view showing a discharge vessel 1E according to the present embodiment. FIG. 9 is a cross sectional view showing a central luminous portion 2E of the discharge vessel 1E. The discharge vessel 1E has a central luminous portion 2E and a pair of end portions 3. The central luminous portion 2E has a upper part 22A and a lower part 22B. As shown in FIG. 9, the upper part 22A has a protrusion 10C having a substantially constant thickness on the inner surface 2*b*. The protrusion 10C is provided on the inner surface substantially across the upper half of the central luminous portion 2E. A protrusion is not provided on the outer surface 2*a* of the central luminous portion 2E. The central luminous portion 2E takes the maximum wall thickness "t" at the protrusion 10C. The maximum wall thickness "t" is a sum of the wall thickness "t3" of the lower part and the thickness "t2" of the protrusion 10C. The wall thickness "t" of the upper part 22A is thus larger than the wall thickness "t3" of the lower part 22B. In the present example, it is provided that the wall thickness "t1" of the connecting portion 4 is substantially same as the wall thickness "t3" of the lower part 22B.

Figure 10:
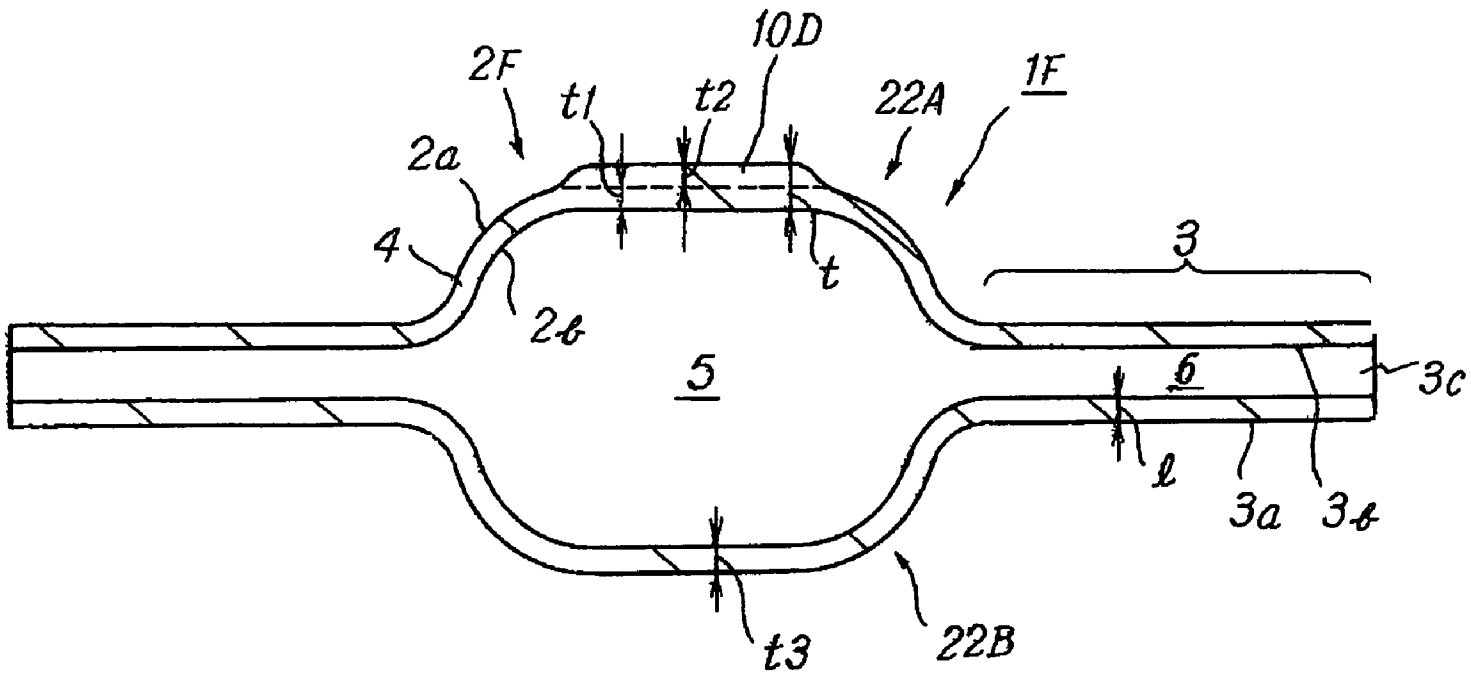
FIG. 10 is a longitudinal sectional view schematically showing a discharge vessel 1F having a central luminous portion 2F with an upper part and a lower portion 22B according to still another embodiment, the upper part 22A having a wall thickness "t" larger than the wall thickness "t3" of the lower part 22B.

FIG. 10 shows a discharge vessel 1F having a central luminous portion 2F and a pair of end portions 3. The central luminous portion 2F has an upper part 22A and a lower part 22B. The upper part 22 has a protrusion 10D having a substantially constant thickness on the outer surface 2*a*. The protrusion 10D is provided on the inner surface of the upper half of the central luminous portion 2F. A protrusion is not provided on the substantially flat inner surface 2*b* of the central luminous potion 2F. The central luminous portion 2F takes the maximum wall thickness "t" at the protrusion 10D. The maximum wall thickness "t" is a sum of the wall thickness "t3" of the lower part, 22B and the thickness "t2" of the protrusion 10D. The wall thickness, "t" of the upper part 22A is larger than the wall thickness "t3" of the lower part 22B.

When a protrusion with a substantially constant thickness is provided in the central luminous portion, for example as described in the above embodiments, the thickness "t2" of the protrusion may preferably be 0.1 times or larger of the maximum wall thickness "t" of the central luminous portion. The thermal capacity of the upper half of the inner space 5 can be increased to reduce the temperature difference between the upper and lower parts of the central luminous portion. On the viewpoint, the thickness "t2" of the protrusion may more preferably be 0.2 times or larger of the maximum wall thickness "t" of the central luminous portion.

The thickness "t2" of the protrusion may preferably be 0.5 times or smaller of the maximum wall thickness "t" of the central luminous portion, to reduce the difference of wall thickness with the connecting portion 4. It is thus possible to prevent the stress concentration and to maintain the strength at a high value. Further, as the maximum wall thickness "t" is larger, the transparency becomes lower. For preventing the reduction of the transparency, the thickness "t2" of the protrusion may preferably be 0.6 times or smaller of the maximum wall thickness "t" of the central luminous portion.

In a preferred embodiment, the wall thickness "t1" of the connecting portion 4 is 0.8 times or larger and 1.2 times or smaller, of, and may most preferably be substantially same as, the wall thickness "t3" of the lower part 22B. Further, the maximum wall thickness "t" of the central luminous portion may preferably be 0.6 mm or larger on the viewpoint of the advantageous effects of the present invention. The maximum wall thickness "t" may preferably be. 2.0 mm or smaller for improving the transparency.

A most preferred process for producing the high pressure discharge lamp according to the present invention will be described below.

A ceramic discharge vessel is shaped, dewaxed and calcined to obtain a calcined body of the discharge vessel. A calcined body for a sealing member is inserted into the end, portion of the resulting calcined body of the discharge vessel, set at a predetermined position and finish-sintered under reducing atmosphere of a dew point of −15 to 15° C. at a temperature of 1600 to 1900° C. to obtain a ceramic discharge vessel having a sealing member.

The calcined body for a sealing member may be produced as follows. Powdery raw material for the sealing member is shaped to obtain a ring-shaped body. In the shaping step, powder granulated by spray drying or the like may be pressed at a pressure of 2000 to 3000 kgf/cm$^2$. The thus obtained shaped body may preferably be dewaxed and calcined to obtain the calcined body. The dewaxing may preferably carried out at a temperature of 600 to 800° C. The calcination may preferably be carried out at a temperature of 1200 to 1400° C. and under hydrogen reducing atmosphere.

Also, powder or frit is pre-formulated to a predetermined glass composition, crashed, granulated with an added binder such as polyvinyl alcohol or the like, press-molded and dewaxed to obtain a glass material for sealing. Alternatively, powder or frit for a glass is molten and solidified to obtain a solid, which is then crashed, granulated with added binder, press molded and dewaxed to obtain a glass material for sealing. In this case, it is preferred to add 3 to 5 weight percent of a binder to the glass formulation, to press-mold at a pressure of 1 to 5 ton, to dewax at about 700° C. and to calcine at a temperature of about 1000 to 1200° C.

The thus obtained discharge vessel conductive member and glass for sealing are assembled and heated at a temperature of 1000 to 1600° C. under a non-oxidizing atmosphere.

EXAMPLES

Figure 2:
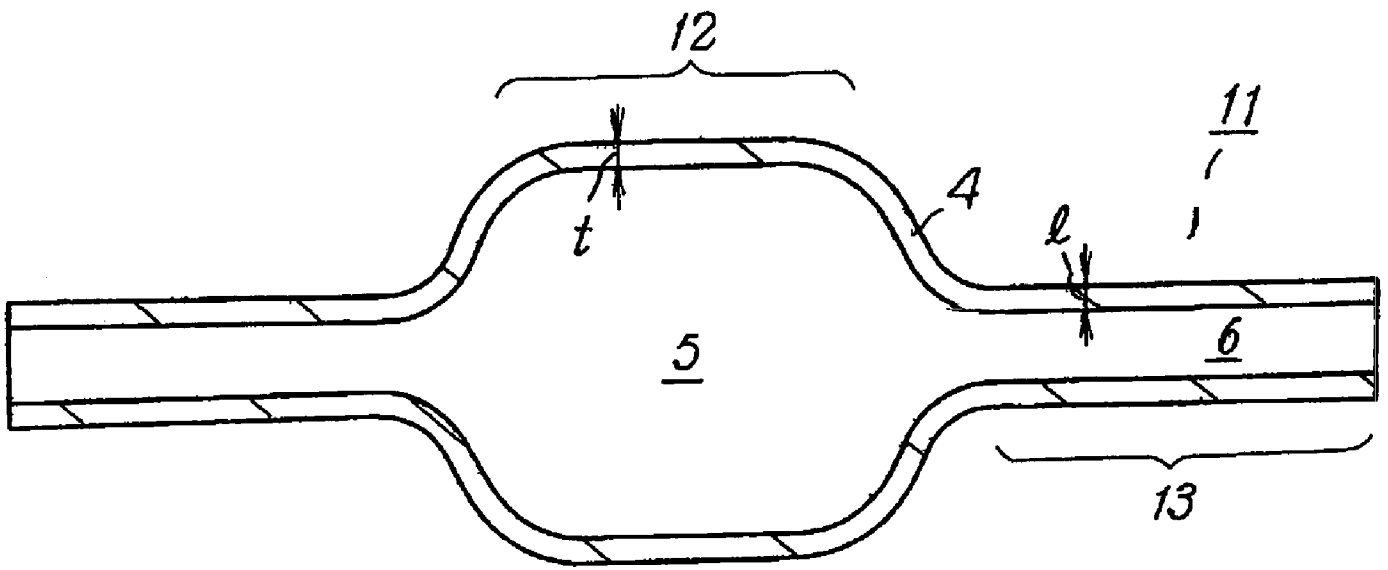
FIG. 2 is a longitudinal sectional view schematically showing a discharge vessel 11A according to a comparative example.

The discharge vessels 1A and 11 described referring to FIGS. 1 and 2, as well as the high pressure discharge lamps having the vessels were produced according to the procedure described above. Specifically, the discharge vessel was formed of an alumina porcelain, and the conductive member was made of a conductive cermet of 50 weight percent of molybdenum and 50 weight percent of alumina. The glass for sealing had a composition of 60 weight percent of dysprosium oxide, 15 weight percent of alumina and 25 weight percent of silica.

The length of the end portion 3 of the discharge vessel was 15 mm, the wall thickness "l" of the end portion 3 was 1.0 mm, and the length of the central luminous portion 2A or 12 was 10 mm. The wall thickness "t" of the central luminous portion 2A was changed as shown in table 1. A supplied power to the electrodes was adjusted so that the maximum temperature in the central luminous portion 2A was about 1200° C. The luminous efficiency was measured. The relative value of the luminous efficiency obtained in each, example was shown in table 1, provided that a value of 100 was assigned as the luminous efficiency when the wall thickness "1" of the end portion was 1.0 mm ("1" is 10 times larger than "t").

TABLE 1

| Wall thickness "l" of End portion (mm) | l/t | Luminous Efficiency (relative ratio) | The other Observation |
|---|---|---|---|
| 1.0 | 1.0 | 100 | |
| 0.9 | 0.9 | 103 | |
| 0.6 | 0.6 | 110 | |
| 0.5 | 0.5 | 112 | |
| 0.4 | 0.4 | Not measurable | Fracture in End portion |

As can be seen from the examples, according to the present invention, the luminous efficiency of the high pressure discharge lamp can be successfully and considerably improved without an increase of the maximum temperature in the central luminous portion.

As described above, the present invention provides a ceramic discharge vessel for improving the luminous efficiency of a high pressure discharge lamp.

The present invention has been explained referring to the preferred embodiments. The invention is, however, not limited to the illustrated embodiments which are given by way of examples only, and may be carried out in various modes without departing from the scope of the invention.

The invention claimed is:

1. A ceramic discharge vessel for a high pressure discharge lamp and for filling an ionizable luminous substance and a starter gas in the inner space of said vessel;

said vessel comprising a tubular or spherical central luminous portion, and a pair of tubular end portions protruding from both ends of said central luminous portion, respectively, wherein each of said end portions has a maximum wall thickness smaller than that of said central luminous portion, wherein the minimum wall thickness of said central luminous portion is 0.5 times or more and 0.9 times or less of the maximum wall thickness at a cross section of said central luminous portion.

2. The discharge vessel of claim 1 to be fixed horizontally.

3. A high pressure discharge lamp, comprising said discharge vessel of claim 1, an electrode system provided in said inner space, a sealing member fixed on said end portion, and a conductive member fixed on said sealing member and equipped with said electrode system.

4. A ceramic discharge vessel for a high pressure discharge lamp and for filling an ionizable luminous substance and a starter gas in the inner space of said vessel;

said vessel comprising a tubular or spherical central luminous portion, and a pair of tubular end portions protruding from both ends of said central luminous portion, respectively, wherein each of said end portions has a maximum wall thickness smaller than that of said central luminous portion; and a protrusion protruding from the outer surface of said central luminous portion and having a substantially constant thickness, and said central luminous portion takes the maximum wall thickness at said protrusion.

5. The discharge vessel for a high pressure discharge lamp of claim 4, wherein said maximum wall thickness of said end portion is 0.5 times or more and 0.9 times or less of that of said central luminous portion.

6. The discharge vessel of claim 4, wherein said maximum wall thickness of said end portion is 0.5 mm or more.

7. A high pressure discharge lamp, comprising said discharge vessel of claim 4, an electrode system provided in said inner space, a sealing member fixed on said end portion, and a conductive member fixed on said sealing member and equipped with said electrode system.

8. A ceramic discharge vessel for a high pressure discharge lamp and for filling an ionizable luminous substance and a starter gas in the inner space of said vessel;

said vessel comprising a tubular or spherical central luminous portion, and a pair of tubular end portions protruding from both ends of said central luminous portion, respectively, wherein each of said end portions has a maximum wall thickness smaller than that of said central luminous portion, and a protrusion protruding from the inner surface of said central luminous portion and having a substantially constant thickness, and said central luminous portion has the maximum wall thickness at said protrusion.

9. The discharge vessel for a high pressure discharge lamp of claim 8, wherein said maximum wall thickness of said end portion is 0.5 times of more and 0.9 times or less of that of said central luminous portion.

10. The discharge vessel of claim 8, wherein said maximum wall thickness of said end portion is 0.5 mm or more.

11. A high pressure discharge lamp, comprising said discharge vessel of claim 8, an electrode system provided in said inner space, a sealing member fixed on said end portion, and a conductive member fixed on said sealing member and equipped with said electrode system.

* * * * *